US006024540A

United States Patent [19]

Navarro Bonet

[11] Patent Number: 6,024,540

[45] Date of Patent: Feb. 15, 2000

[54] PUMP FOR PUMPING THROUGH A VARIABLE VOLUME PLUNGER CHAMBER HAVING A PAIR OF PLUNGERS DISPOSED IN A STEPPED CYLINDER WITH A SLIDE VALVE

[76] Inventor: Jose Manuel Navarro Bonet, Avenida Federico Soto, 5, E-03003 Alicante, Spain

[21] Appl. No.: 08/836,893

[22] PCT Filed: Sep. 20, 1996

[86] PCT No.: PCT/ES96/00182

§ 371 Date: Aug. 28, 1997

§ 102(e) Date: Aug. 28, 1997

[87] PCT Pub. No.: WO97/11007

PCT Pub. Date: Mar. 22, 1997

[30] Foreign Application Priority Data

Sep. 22, 1995 [ES] Spain ..... 9501842

[51] Int. Cl.[7] ..... F04B 25/02

[52] U.S. Cl. ..... 417/259; 239/321

[58] Field of Search ..... 417/259, 547, 417/552, 551

[56] References Cited

U.S. PATENT DOCUMENTS

| | | | |
|---|---|---|---|
| 211,168 | 1/1879 | Loudon | 417/547 |
| 376,696 | 1/1888 | Webster | 417/547 |
| 975,781 | 11/1910 | Morris | 417/547 |
| 3,131,646 | 5/1964 | Parrott | 103/188 |
| 3,257,961 | 6/1966 | Schlenker | 103/178 |
| 3,627,206 | 12/1971 | Boris | 239/321 |
| 3,680,790 | 8/1972 | Boris | 239/353 |
| 3,695,787 | 10/1972 | Kraus | 417/547 |
| 3,765,272 | 10/1973 | Kolehmainen et al. | 477/100 |
| 4,381,180 | 4/1983 | Sell | 417/393 |
| 4,386,888 | 6/1983 | Verley | 417/393 |
| 4,877,296 | 10/1989 | Leiber et al. | 303/113.4 |
| 5,062,770 | 11/1991 | Story et al. | 417/46 |
| 5,094,081 | 3/1992 | Osborne | 60/563 |
| 5,257,914 | 11/1993 | Reynolds | 417/293 |
| 5,260,358 | 11/1993 | Shimizu et al. | 524/31 |

FOREIGN PATENT DOCUMENTS 2 082 807 12/1971 France .

*Primary Examiner*—Charles G. Freay
*Assistant Examiner*—Robert Z. Evora
*Attorney, Agent, or Firm*—Larson & Taylor

[57] ABSTRACT

A pump for pumping through a variable plunger chamber having a pair of plungers disposed in a stepped cylinder with a slide valve includes two plungers of different diameters, united to each other. As they move within a stepped cylinder, the plungers form a chamber of variable volume according to the ratio of their height in respect of the step formed by the cylinder. The ports and clearance between the stem and the plunger chamber create intake, by means of the port housed in the plunger chamber on driving the stem in its upward stroke, and drive by means of the port drilled in the stem on forcing the stem in its downward stroke. Just three structural components are needed for operation of the pump.

5 Claims, 11 Drawing Sheets

PUMP FOR PUMPING THROUGH A VARIABLE VOLUME PLUNGER CHAMBER HAVING A PAIR OF PLUNGERS DISPOSED IN A STEPPED CYLINDER WITH A SLIDE VALVE

FIELD OF THE INVENTION

This invention relates to the technical field of hydraulics.

BACKGROUND OF THE INVENTION

Pumps are classified according to the movement of the force body of the pump, such as:

1) piston pumps, wherein the drive piston has a reciprocating straight-line movement;

2) rotary pumps, wherein the drive piston has a reciprocating angular movement; and 3) centrifugal pumps, wherein the body turns inside the pump body.

The following are descriptions of the prior art types of piston pumps:

Single acting pumps: on the upward stroke, it lifts by opening the intake valve, which is housed in the cylindrical valve inlet. On the downward stroke, it closes this valve and, in turn, opens the delivery valve through which it discharges the volume of the contents of the cylinder.

Valve piston pumps: the delivery valve is mounted on the plunger, which has openings. The plunger thereby forms two chambers in the cylindrical body, intake taking place in the lower chamber, and compression taking place in the upper chamber when the plunger rises.

Tubular piston pumps: the plunger consists of a tube carrying the delivery valve actuated by a rod on its outside.

Double-acting pumps: made by joining two single-acting pumps.

Horizontal plunger pumps: consist of a plunger shared by two pumps. On each stroke, one side of the plunger lifts while the other compresses.

Differential pumps with horizontal and vertical plunger: on the upward stroke of the plunger, intake and injection into the delivery tube take place at the same time. On the downward stroke, the lower side of the plunger causes an injection through a union tube into the upper cylindrical space. However, the plunger stem also displaces fluids which pass to the delivery tube. Therefore, the pump works through intake and compression on the upward stroke, and on the downward stroke by compression only.

The components of conventional piston pumps are:

Cylinder

Piston

Piston drive stem

Intake valve casing box with its valve

Delivery valve box with its valve.

SUMMARY OF THE INVENTION

A pump for pumping through a variable volume plunger chamber having a pair of plungers disposed in a stepped cylinder with a slide valve includes two plungers of different diameters united to a single stem and housing in a cylinder. On the plunger-stroke, a difference of volumes occurs.

Pumping is achieved through intake and drive by means of valves which direct the flow in only one direction. The pumping is not the result of piston displacement, but the volume loss in the cylinder due to its variable diameter.

The two plungers shifted by a single rod on each stroke in a cylinder of two different diameters create a chamber of variable diameter which causes the displacement of fluids.

DESCRIPTION OF THE PREFERRED EMBODIMENTS

Figure 1:
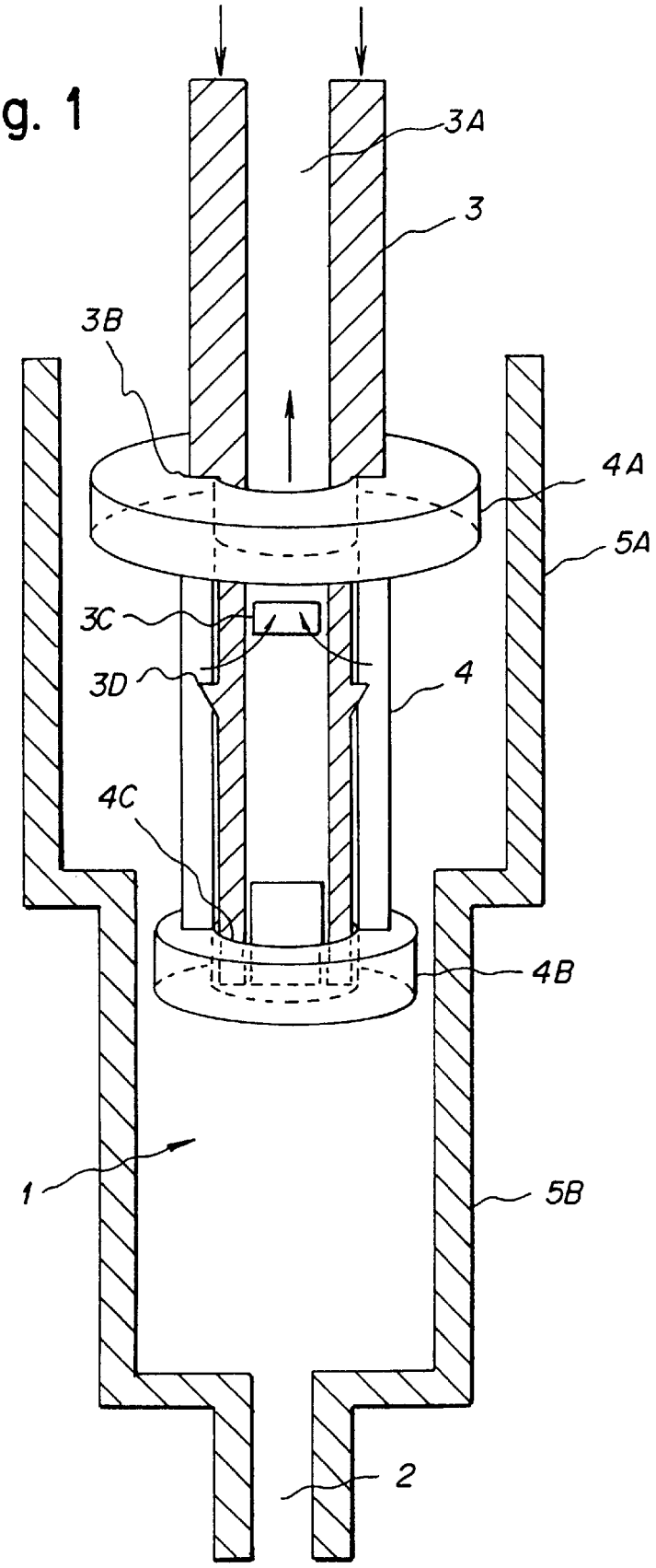
FIG. 1 is a vertical section view of the pump in the position of pressure on the stem.
Figure 11:
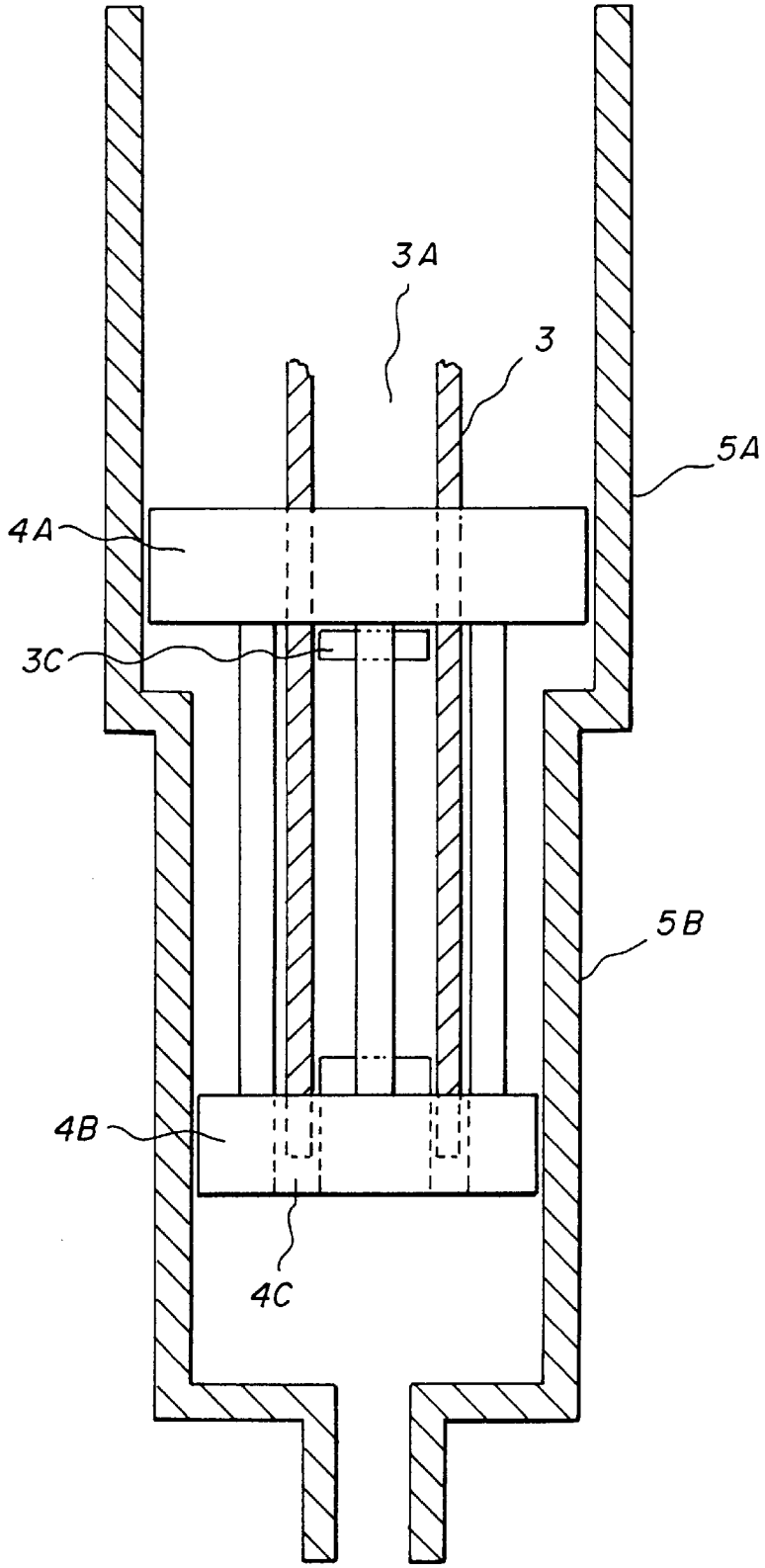

The pump includes an intake pipe 2 and a hollow stem 3, surrounded at its lower end by a plunger chamber 4, so that when the pump body 1 and the intake tube 2 are filled with air (FIGS. 1,11) the hollow stem 3 rises, on its upward travel it draws the plunger chamber 4, the liquid then follows an upper plunger 4A in its ascent, and pump intake takes place. The amount of liquid which enters into the pump body is equal to the product of the plunger action due to its travel. When the hollow stem 3 moves down, that is during drive, it causes the plunger chamber 4 to descend, and the plungers 4A, 4B inject the amount of the differential volume between the cylinders 5A, 5B into the delivery pipe 3A.

On each drive the fluid level into the delivery pipe 3A rises until it reaches the draining opening.

The pump body 1 has two stages of different diameters, cylinders 5A, 5B once the pump body 1 and the delivery pipe 3A are full of liquid; at each stroke a quantity of liquid equal to the difference in the capacities formed by the two different diameters, both of the plungers 4A, 4B and of the cylinders 5A, 5B, enters into the cylinder formed between the plungers 4A, 4B, and at each drive stroke the same amount of liquid enters into the delivery pipe 3A.

The plunger chamber 4 on the upper plunger 4A has a stop 3B so that, when the pump is positioned vertically, pressing the stem 3 draws the plunger chamber 4 in its descent by means of the stop 3B, closing at the same time its intake port 4C (FIG. 3), and opening the delivery port 3C drilled in the stem 3, by which the fluids are discharged.

Figure 2:
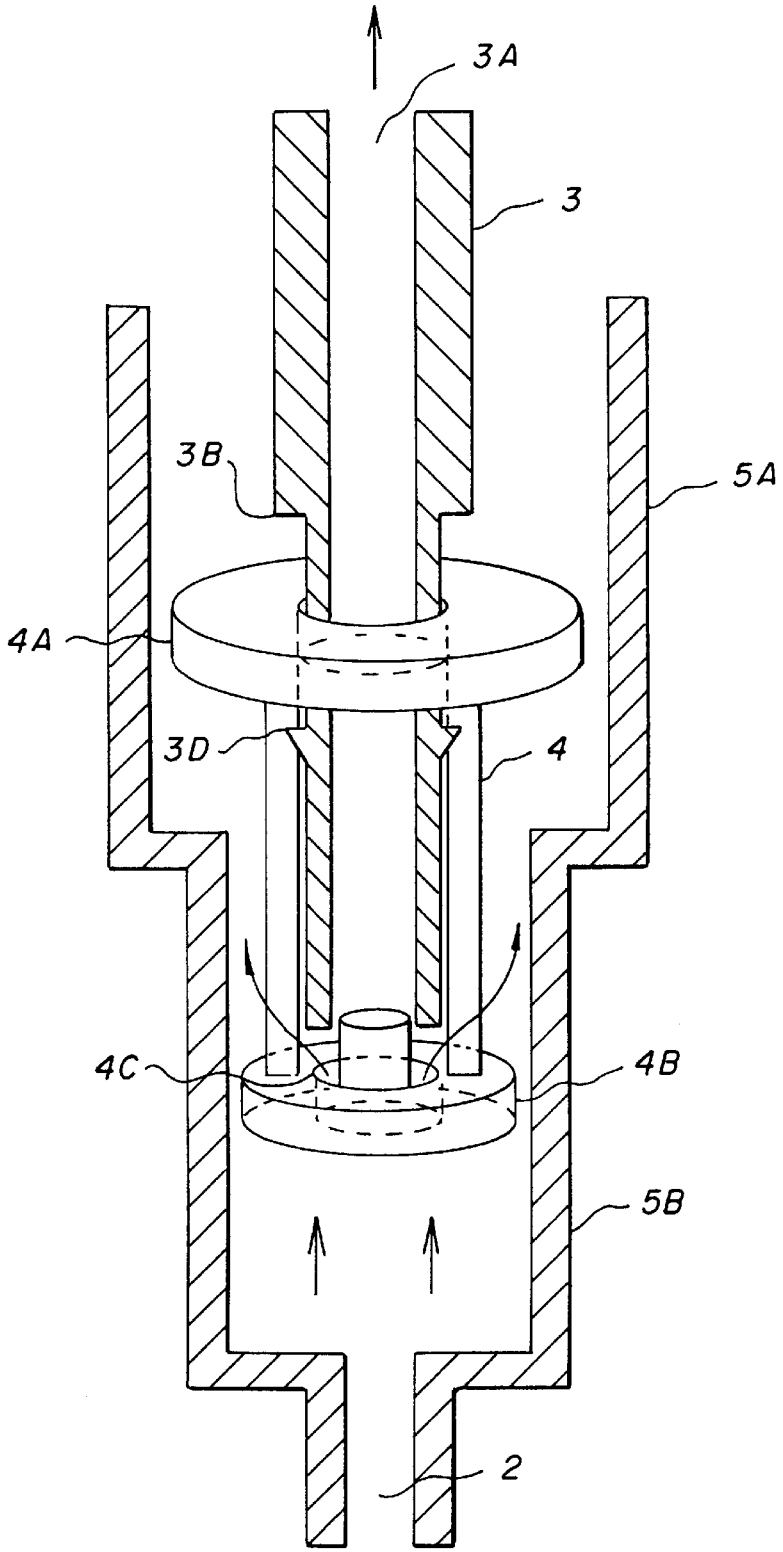
FIG. 2 is a vertical sectional view of the pump in the intake position.
Figure 10:
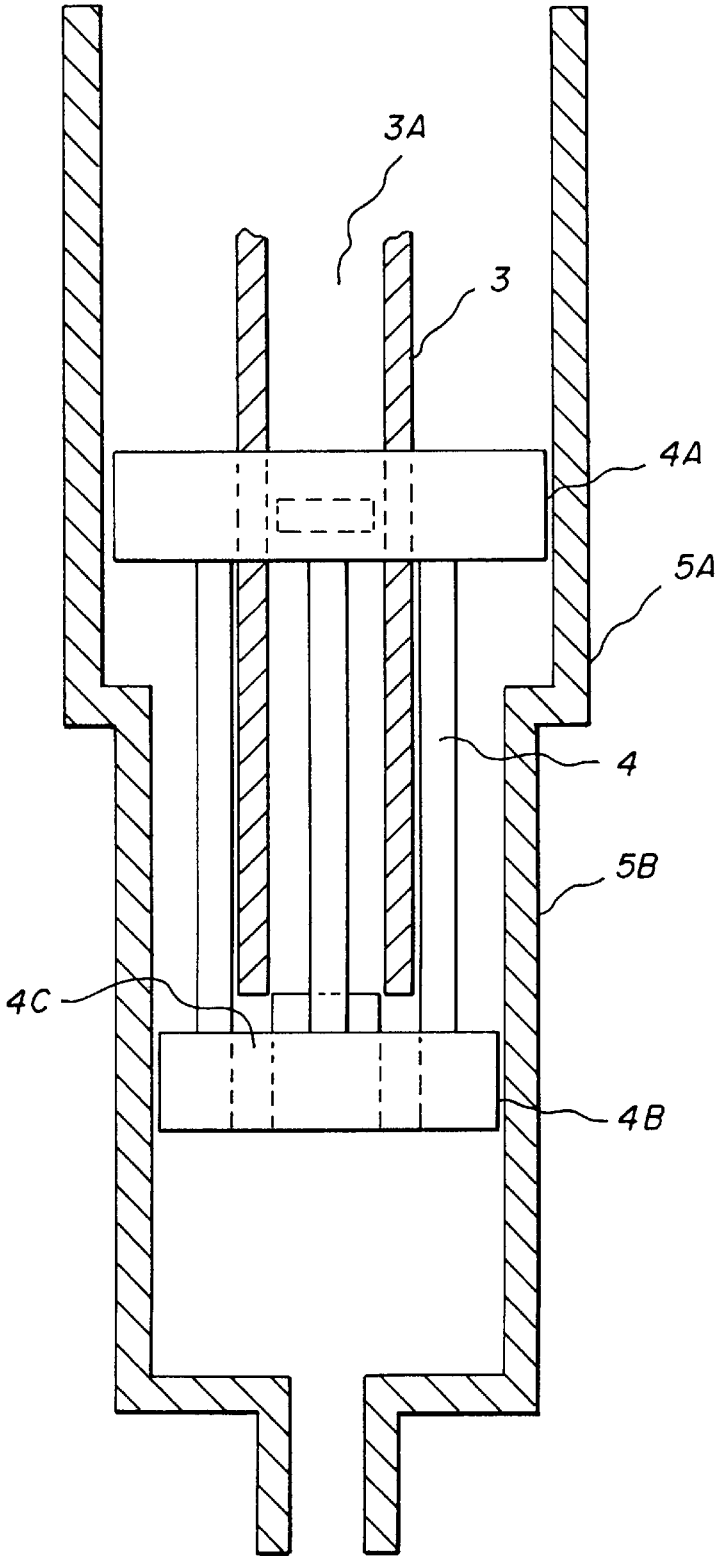
FIGS. 10 and 11 are vertical sectional views of the pumps in positions shown in FIGS. 2 and 1, respectively.

As shown in FIGS. 2,10 once the downstroke is completed, the stem 3 is no longer pressed so that the stem 3, helped by a spring, begins its upward stroke, drawing the plunger body. Because of the clearance between the stem 3, stops 3B, 3D will cause the plugging of the delivery port 3C and opening of the port 4C in the plunger chamber 4 whereby the fluids will begin to enter the variable diameter cylinder 5A, 5B. This causes the pumping of the volumetric difference between the cylinders 5A, 5B to take place.

Figure 3:
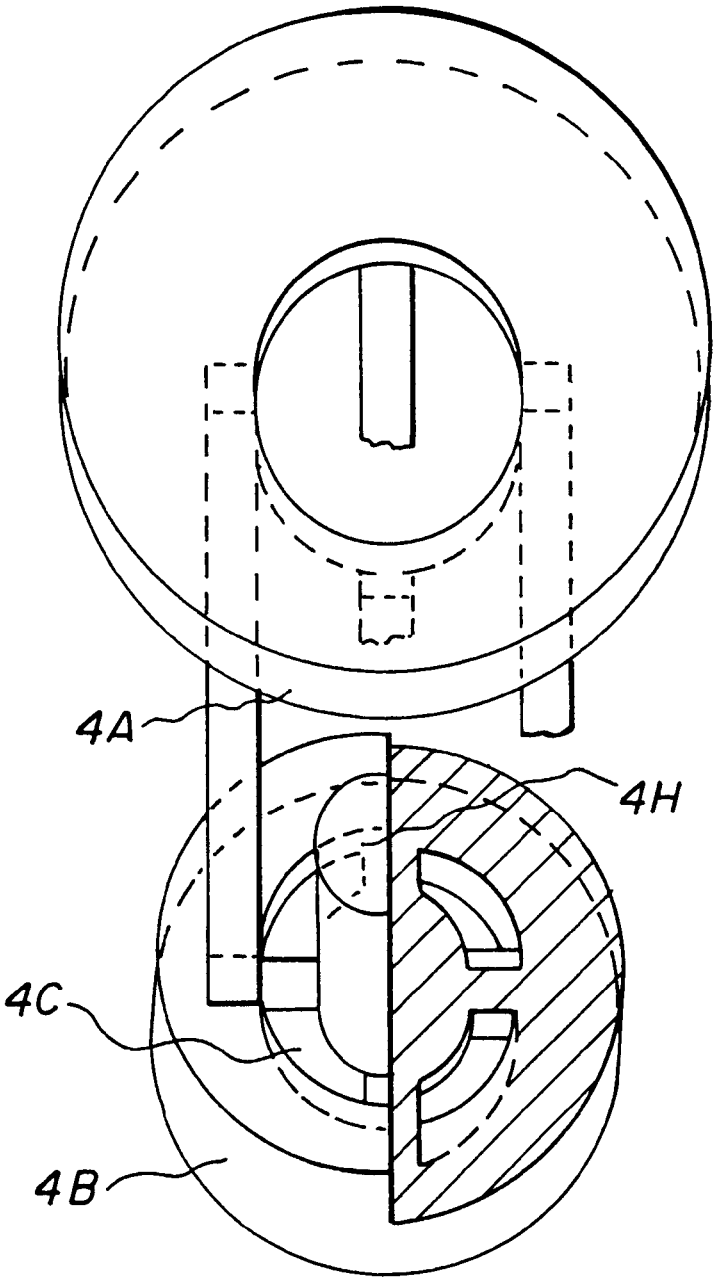
FIG. 3 is a perspective and sectional view of the plunger chamber.

As shown in FIG. 3, the plunger chamber is provided with a plug 4H to plug the lower end of the stem.

On this pump, the following elements have been replaced:

Intake valve box with its valve

Delivery valve box with its valve These elements have been replaced with:

An intake port, located in the lower plunger 4B

A delivery port 3C, drilled in the stem 3

These two ports are opened and closed by means of the clearances in the displacements of the stem 3 and plunger chamber 4.

Therefore only three component parts are needed to attain pumping:

cylinders 5A, 5B, plunger chamber 4, and stem 3.

Figure 7:
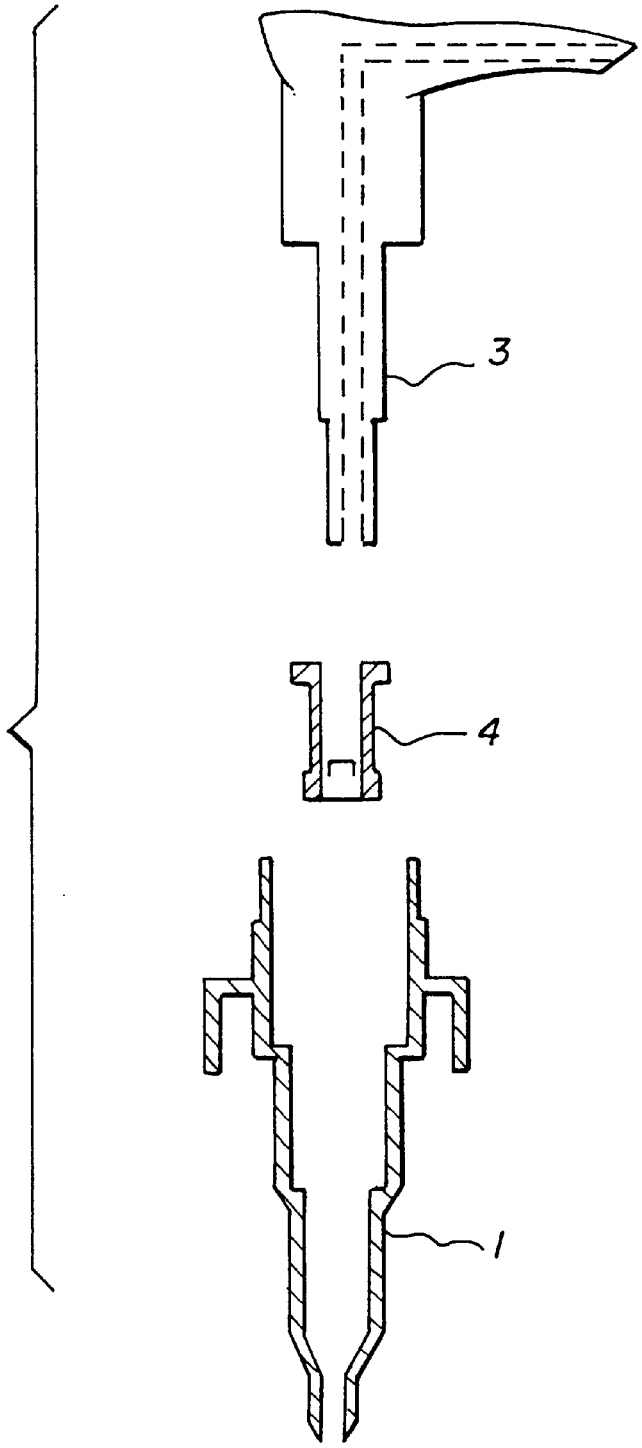
FIG. 7 is a vertical sectional view showing a specimen embodiment of this invention as a cosmetic product metering pump.

By the use of plastic-injection molding each part can be produced in single units. On assembly of the pump only these three component parts and the return spring are required. A total of four fabricated pieces for full operation, for example, of a metering pump for cosmetics products (FIG. 7), consisting of:

A stem 3 incorporating a delivery port 3C the liquid outlet head being integrated into this part and the stem's bottom aperture being plugged by the cylinder integrated into the part that forms the plunger chamber 4.

A plunger chamber 4 with its intake port and integral cylinder to seal the lower opening of the stem.

A variable diameter chamber 1, including an adjusting cap with the metering device.

A return spring.

Figure 4:
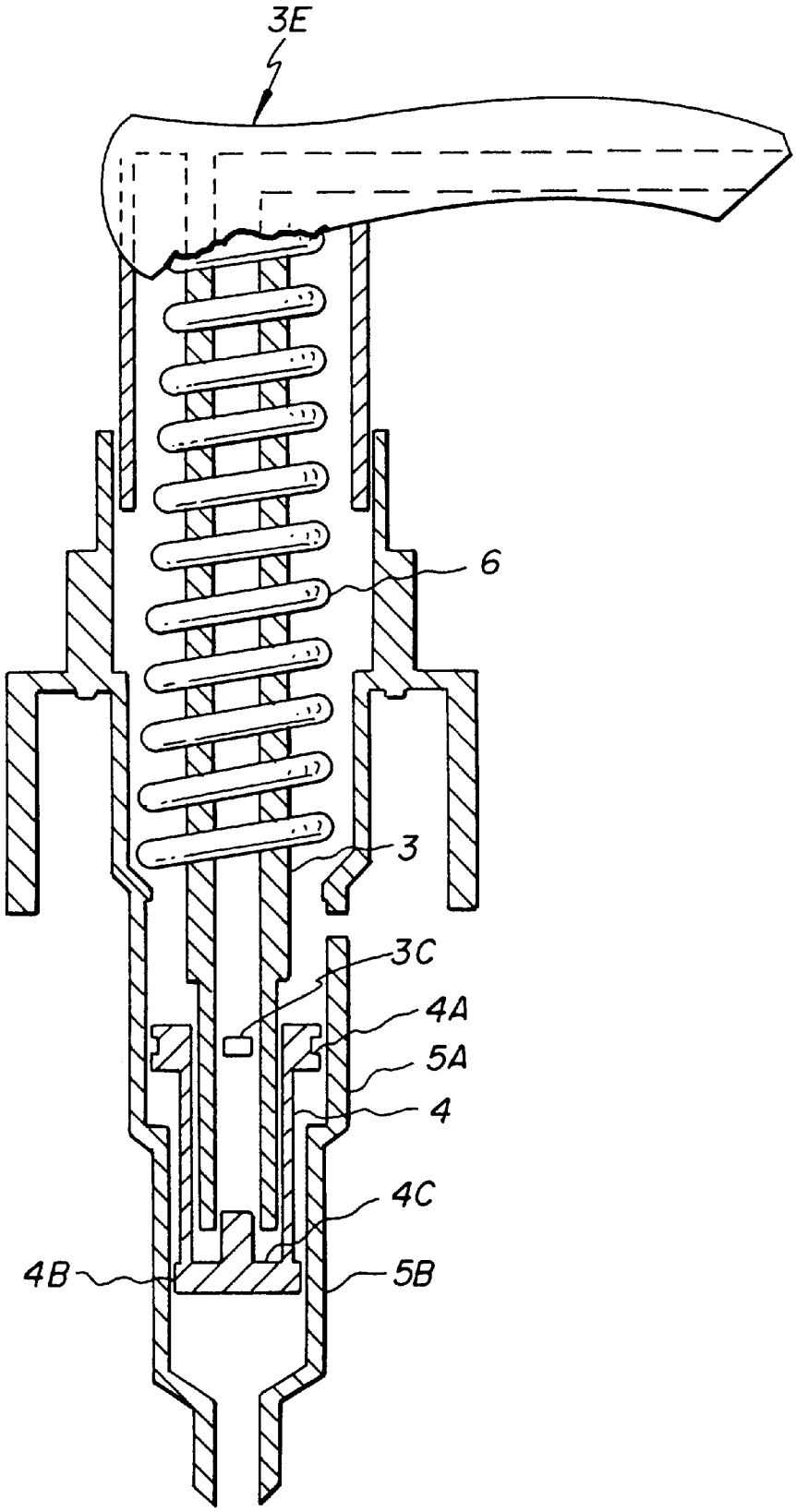
FIG. 4 is a vertical sectional view of the pump in its metering version, in the intake position.
Figure 5:
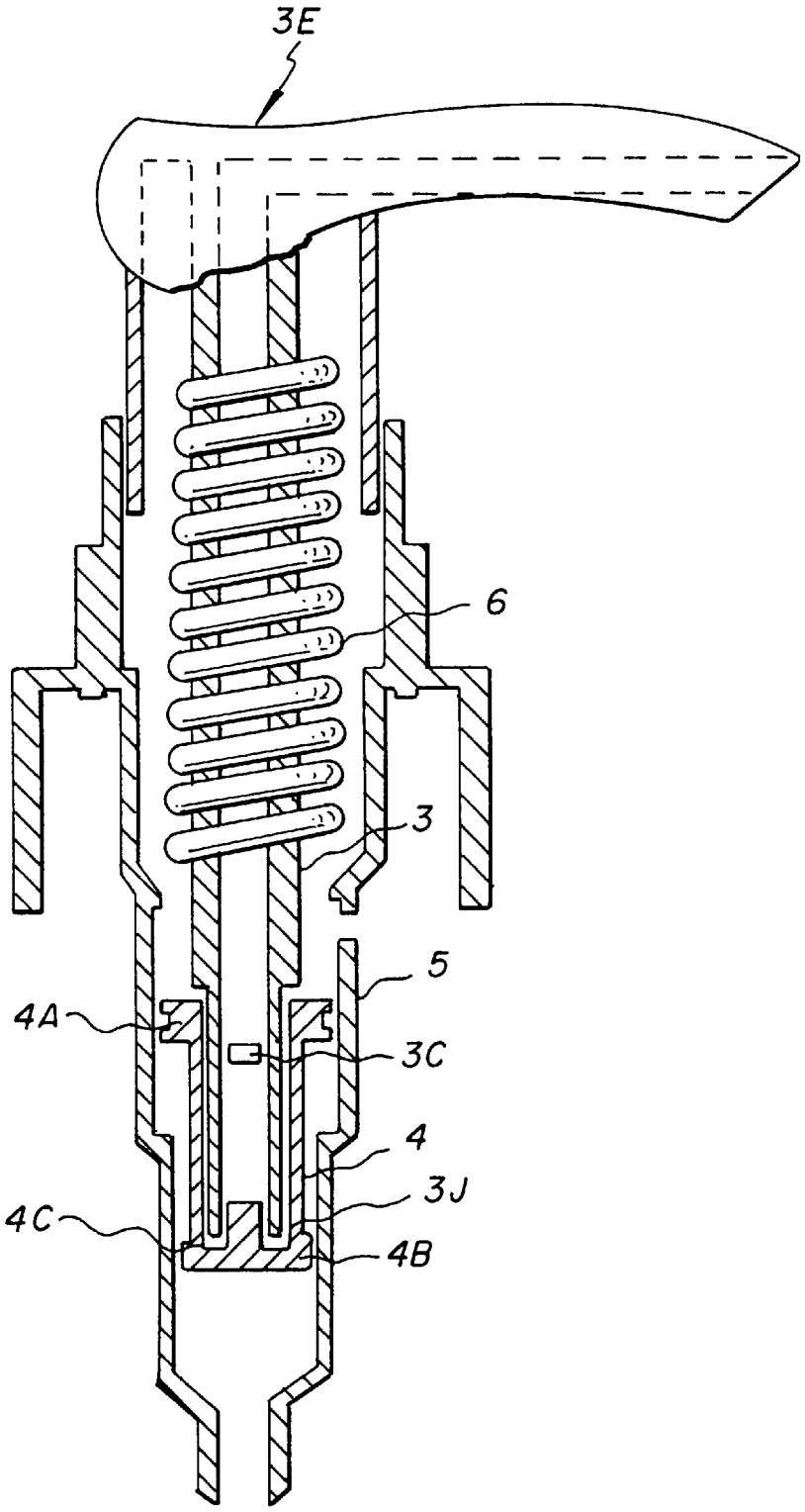
FIG. 5 is a vertical sectional view of the pump in its metering version, in the drive position.
Figure 6:
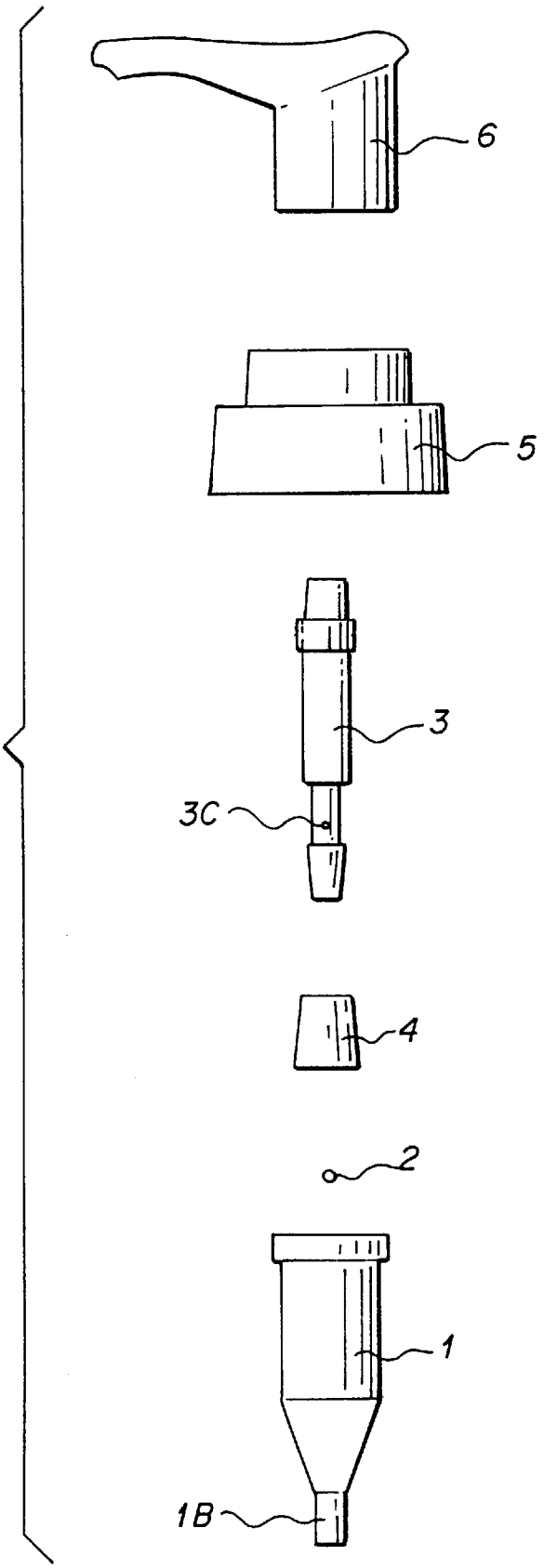
FIG. 6 shows a diagram of the plastic parts required for the execution of a current metering pump.

A metering pump is therefore achieved by the utilization of only four components. FIGS. 4 and 5 show the metering pump in intake and drive positions. FIG. 6 shows the plastic components necessary for the fabrication of an actual metering pump, with the addition of the return spring. The seating of the intake valve 1B can be integrated in the chamber 1. For the valve 1B, an enclosing cone or sphere is used. Another component is the plunger situated on the plunger-rod, where a delivery port 4 has been drilled. This port is opened and closed by the clearance between the stem 3 and the plunger 4. The fluid outlet head cannot be built into the stem 3, because in the plastic-injection molding process the aperture at the bottom of the stem 3 could not be plugged to prevent the reflux of fluid forced into the pump chamber. The adjusting cap 5 with the liquid reservoir are included in the stem 3 locating guide. It can be seen that six integral pieces are necessary for a metering pump. There are other types in existence, which need more than six pieces, utilizing tubular plungers. It can therefore be observed that the variable volume plunger chamber metering pump is that which requires least fabricated components. It can also work in any position, without needing any elements which press on or maintain valves in their seating.

Figure 9:
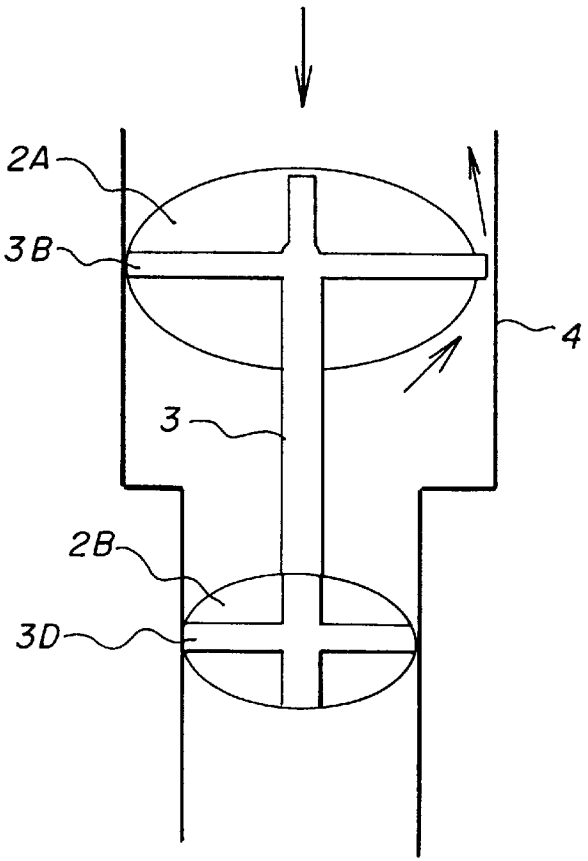
FIGS. 8 and 9 are vertical sectional views of the embodiment of the invention using diaphragms.
Figure 8:
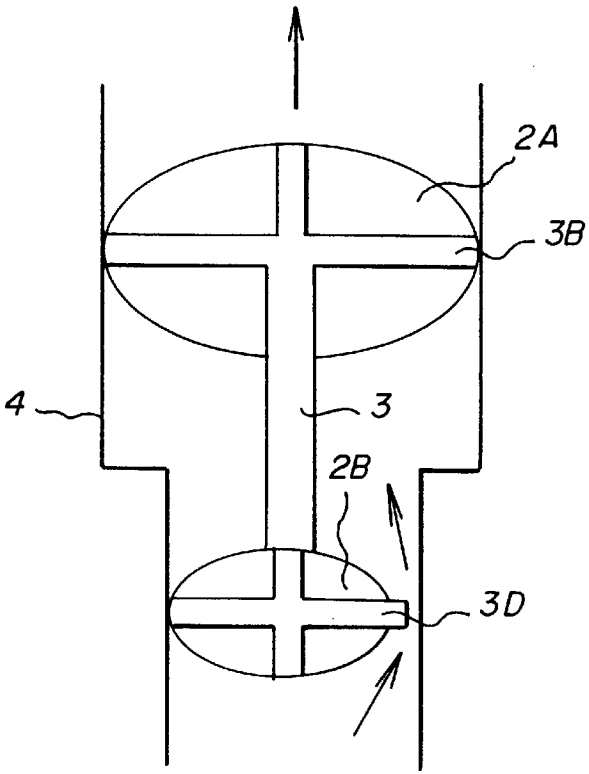

In another embodiment illustrated by FIGS. 8 and 9, two diaphragms 2A, 2B of different diameters attached to the same stem 3 are housed in a cylinder 4 in the stroke of which the diameters of the diaphragms 2A, 2B are included half and half. On the upstroke of the stems, the upper diaphragm 2A assisted by its lower stops 3A allow the diaphragm 2A to remain taut and flush with the cylinder 4 surface, creating a vacuum on the upward stroke, which raises the ends of the lower diaphragm 2B through atmospheric pressure. A displacement of fluids takes place, into the volume formed between the underside of the upper diaphragm 2A and the top side of the lower diaphragm 2B. On the downstroke, the liquid inside the pump chamber puts pressure on the diaphragms 2A, 2B, while putting less pressure on the stops 3B and the cylinder wall 4, thereby preventing the escape of liquid over its edges. The upper diaphragm 2A flexes under the resultant pressure and the liquid is forced over the lip of the diaphragm 2A into the upper cavity of the cylinder. Through this process, the pumping action is achieved.

Figure 12:
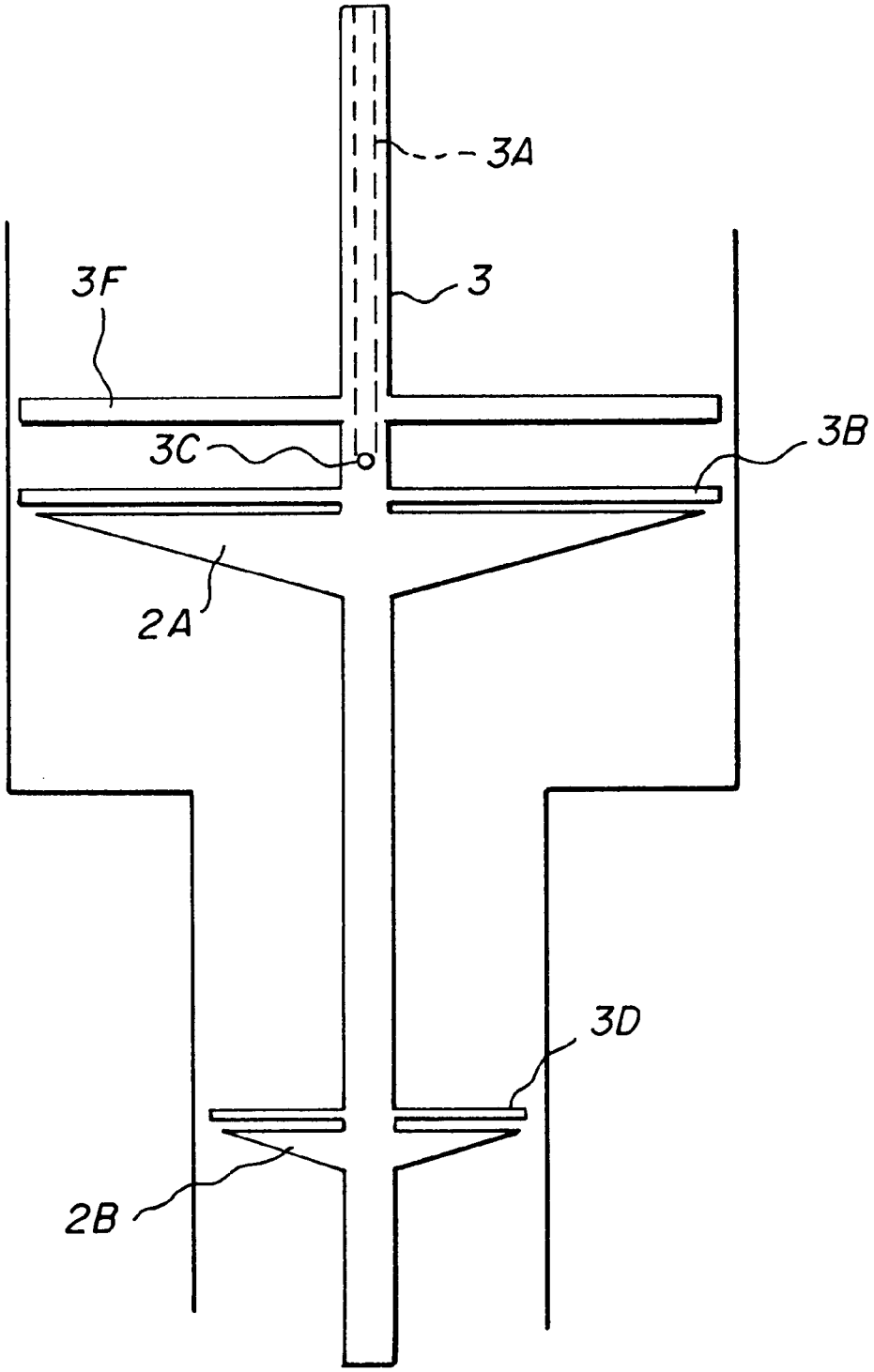
FIG. 12 is a vertical sectional view showing an embodiment of this invention by means of a hollow stem with two diaphragms.

FIG. 12 shows the hollow stem 3, with the upper and lower diaphragms 2A, 2B. The stem 3 is bored above the upper diaphragm, to thereby force fluids through the stem 3 due to the action of the retaining plunger 3F located above the port 3C in the stem 3. Stops 3B, 3D prevent flexing of the upper and lower diaphragms 2A, 2B.

I claim:

1. A pump for pumping through a variable volume plunger chamber comprising: a stepped cylinder having a first chamber having a comparatively large diameter and a second chamber having a comparatively small diameter;

an upper plunger having a comparatively large diameter and a lower plunger having a comparatively small diameter, said plungers being united to each other and moving through the stepped cylinder;

a hollow stem slideable inside the stepped cylinder for plugging a first port drilled in the smaller diameter plunger, while at the same time uncovering a second port in the hollow stem which was previously sealed by the larger diameter plunger, whereby fluids are forced through the second port as volume of the larger diameter chamber decreases and, when the stroke is completed, the hollow stem rises leaving the first port open, while at the same time closing the second port.

2. The pump according to claim 1 wherein an inlet valve is located in the lower plunger.

3. A pump for pumping through a variable volume plunger chamber comprising a pair of plungers of different diameters disposed in a stepped cylinder having a slide valve, the pair of plungers comprising an upper and a lower plunger formed as a single component; and, the slide valve comprising a hollow stem slidable inside the variable volume plunger chamber for plugging a first port drilled in the lower plunger, while at the same time uncovering a second port in the hollow stem which was previously sealed by the upper plunger, whereby fluids are forced through the second port as volume in the chamber changes and, when the stroke is completed, the hollow stem rises leaving the first port open, while at the same time closing the second port.

4. The pump according to claim 3 wherein an inlet valve is located in the lower plunger.

5. A pump for pumping through a variable volume plunger chamber comprising an upper plunger and a lower plunger disposed in a stepped cylinder having a slide valve, the pump including two diaphragms attached to a stem, the diaphragms having different diameters and being housed in a cylinder having bottom stop; and, the slide valve comprising a hollow stem slidable inside the variable volume plunger chamber for plugging a first port drilled in the lower plunger, while at the same time uncovering a second port in the hollow stem which was previously sealed by the upper plunger, whereby fluids are forced through the second port as volume in the chamber changes and, when the stroke is completed, the hollow stem rises leaving the first port open, while at the same time closing the second port.

* * * * *